US006039194A

United States Patent [19]

Beeche et al.

[11] Patent Number: 6,039,194

[45] Date of Patent: Mar. 21, 2000

[54] MOBILE ROOF CRANE

[75] Inventors: Gregory L. Beeche, Mechanicville; Roy Scrafford, Glenville, both of N.Y.

[73] Assignee: Beeche System, Corp., Scotia, N.Y.

[21] Appl. No.: 09/292,269

[22] Filed: Apr. 15, 1999

[51] Int. Cl.[7] ..... B66C 23/18

[52] U.S. Cl. ..... 212/301; 180/411; 212/179; 212/302; 212/306; 212/300

[58] Field of Search ..... 212/299, 300, 212/301, 302, 306, 901, 179, 230, 231, 232; 280/91; 180/411; 182/36, 38

[56] References Cited

U.S. PATENT DOCUMENTS

| | | | |
|---|---|---|---|
| 937,043 | 10/1909 | Bilger | 188/5 |
| 3,081,883 | 3/1963 | Minty | 212/344 |
| 3,130,813 | 4/1964 | Fackler et al. | 182/36 |
| 3,159,110 | 12/1964 | Wylie | 182/36 |
| 3,572,458 | 3/1971 | Tax | 180/411 |
| 3,854,550 | 12/1974 | Shingler | 182/36 |
| 4,008,783 | 2/1977 | Herrmann et al. | 180/411 |
| 4,050,587 | 9/1977 | Moen | 212/901 |
| 4,053,060 | 10/1977 | Wilson | 212/302 |
| 4,200,162 | 4/1980 | Tax | 180/411 |
| 4,469,191 | 9/1984 | Truninger | 212/302 |
| 5,699,873 | 12/1997 | Moriya et al. | 180/411 |
| 5,758,785 | 6/1998 | Spinosa et al. | 212/300 |
| 5,810,183 | 9/1998 | Feider et al. | 212/291 |

FOREIGN PATENT DOCUMENTS

| | | | |
|---|---|---|---|
| 2451673 | 5/1976 | Germany | 212/231 |
| 4-325382 | 11/1992 | Japan | 280/91 |
| 2128144 | 4/1984 | United Kingdom | 212/306 |

*Primary Examiner*—Thomas J. Brahan
*Attorney, Agent, or Firm*—Schmeiser, Olsen & Watts

[57] ABSTRACT

A compact mobile crane for lifting or lowering a load to or from a roof or other location of a building, and for raising, lowering, and supporting a load along the sides of a building. Elements of the mobile crane can be folded to allow the mobile crane to be moved into, and transported by, a standard size building elevator. Wheel assemblies on the carriage of the mobile crane can be configured for four wheel steering, locked in predetermined directions, or free pivoting. The wheel assemblies further include a wheel retraction apparatus for retracting the wheels of the mobile crane to support the crane on fixed length supports. The carriage frame members include rows of holes spaced at equal distances from each other, providing a system for easily fastening numerous elements to the mobile crane.

29 Claims, 15 Drawing Sheets

MOBILE ROOF CRANE

FIELD OF THE INVENTION

The present invention relates generally to crane assemblies, and more particularly, to a compact mobile crane for lifting or lowering a load to or from a roof or other location in a building. Also, the present invention relates to a compact mobile crane for raising, lowering, and supporting a load along the sides of a building.

BACKGROUND OF THE INVENTION

In building construction and maintenance, a large ground based crane is commonly used to lift materials to the sides and top of a building. Such ground based cranes are very expensive to rent and operate, commonly requiring a large number of personnel to transport, set up, maneuver, and operate the crane. Additionally, such ground based cranes have a limited reach, thereby restricting the operational capability of the crane, and are too large and heavy to enter and work within the interior portions of a building.

Many tall buildings are relatively wide at the lower floors, and include a narrower central tower structure comprising a large number of floors. This type of building configuration prevents a ground based crane from extending upwards and inwards a sufficient distance to reach the floors contained in the central tower structure of the building. Also, the large building can be surrounded by many adjacent buildings, preventing ground crane access for building construction, renovation, and maintenance. Thus, a ground based crane generally cannot be used during the construction and maintenance of the central tower structure.

To overcome the height limitation of ground based cranes during the construction of a building, a mast or derrick type roof based crane is commonly used. The roof based crane is typically mounted to the uppermost portion of the building under construction, such that the effective operating height of the crane relative to the ground increases as the height of the building increases. The roof based crane generally includes a boom that can only access the exterior of the building, and that is not capable of reaching into the floors of the building. After construction has been completed, the roof based crane is typically dismantled, and is not available for subsequent maintenance of the exterior of the building.

Thus, there is clearly a need for a crane that can be used in all phases of building construction and maintenance, both on the exterior and interior portions of a building, that does not suffer from the height, weight, and operational constraints of currently available ground and roof based cranes, and that can be easily setup and maneuvered throughout all areas of a building with a minimal amount of effort.

SUMMARY OF THE INVENTION

In order to overcome the above deficiencies, the present invention provides a compact mobile crane assembly, hereafter referred to as a "mobile crane." The mobile crane generally includes a carriage, a plurality of steerable and retractable wheel assemblies, a folding boom, a boom support assembly, a plurality of fixed length carriage support legs, a counterweight, and a hoist motor. Advantageously, unlike prior art cranes, the mobile crane of the present invention can be used to lift or lower loads to or from the roof of a building, along the exterior of the building, or within the interior of the building. Further, the mobile crane of the present invention, due to its compact size, can be easily transported throughout the interior or from floor to floor of the building, thereby eliminating the height and operational restrictions associated with prior art ground and roof based cranes.

Three modes of wheel positioning can be selected for the plurality of wheel assemblies using a single control element. A first mode of wheel positioning provides all wheel steering. In the present invention, at least two wheels can be selected for the all wheel steering mode. Regardless of the actual number of wheels that are selected, this first mode of wheel positioning will hereafter be referred to as "four wheel steering." A second mode of wheel positioning provides fixed independent wheel directions allowing carriage travel parallel and/or perpendicular to the edge of a building, carriage travel in a predetermined direction, and rotatable motion about the center of the carriage. A third mode of wheel positioning allows each wheel assembly to freely swivel in any direction. The control element also allows the wheel positioning mode of each wheel assembly to be independently selected from any of the three wheel positioning modes described above.

When the boom is folded, the wheel assemblies of the mobile crane allow the crane to be easily steered and rolled into a building elevator. The building elevator can then be used to transport the mobile crane to the roof or other work location throughout the building. Therefore, no special equipment is required to transport the mobile crane to the building roof or throughout the building. The boom of the mobile crane is unfolded after the mobile crane is steered and propelled to a work location. When in the proper position, the wheels on the wheel assemblies are retracted allowing the fixed length carriage support legs to rest directly on a support surface, thereby providing a solid stable support for the boom. A hoist motor is attached to the carriage, and a lifting cable attached to the hoist motor is carried over the end of the boom. Also the carriage of the mobile crane functions as a counterweight. An additional counterweight can also be attached to the carriage at the opposite end from the boom.

A boom support assembly can be attached to the boom in order to provide support between a support surface and a mid-portion of the boom. This boom support assembly shifts the fulcrum point from the front wheels or king pin housing supports of the carriage to a point between the carriage and the end of the boom. This increases the counterweight effectiveness of the carriage such that a load of about 3500 pounds instead of about 600 pounds can be lifted by the mobile crane. For further support, a cable may be fastened between an existing building column or other fixed structure and the carriage. In operation, the lifting cable is lowered to the ground or other location and is fastened to a load. The load is then lifted to the work location at the top, sides, or interior of the building.

Existing ground based cranes can weigh 50 to 100 times more than the mobile crane of the present invention, and therefore the ground based cranes cannot be carried to floors within the building. The mobile crane of the present invention weighs only about 2400 pounds which allows it to be carried to any floor using a standard freight elevator in a building.

Also, the components of the mobile crane, such as platforms, boom assemblies or support legs are designed to fit inside of a freight elevator, so that these components can be easily transported to any floor of a building.

The mobile crane of the present invention provides many advantages over a ground based crane. For example, a ground based crane is limited by the boom height and cannot lift beyond this height. In comparison, the mobile crane of the present invention does not have this height limitation since the mobile crane can be used to lift or lower a load to the top or any floor of the building. Also, while a ground based crane requires a large specialized crew to setup and operate the crane, the mobile crane may be easily and quickly setup and operated by one or two people. In addition, the mobile crane can be quickly repositioned around the edge of a building, while a ground based crane requires much more time for relocation.

Another embodiment of the mobile crane includes a work platform system supported from rigid booms attached to the mobile crane carriage. The work platform can be used to lower workers and materials to various work locations along the sides of a building.

Another embodiment of the mobile crane includes a circular track and grooved wheels attached to a lower portion of the boom support assembly. The grooved wheels are placed on top of the circular track and, along with the wheels mounted on the carriage, allow the mobile crane to turn in a turreting motion.

Another embodiment of the present invention includes two carriages that are attached together. The first carriage has a boom mounted on one end, and the second carriage is loaded with weights to provide a large counterweight mass for the mobile crane.

Another embodiment of the present invention includes motors and brakes to provide motive power and braking capabilities to each wheel assembly.

Another embodiment of the present invention includes a carriage with a plurality of regularly spaced openings in the carriage frame. The openings provide locations for the convenient attachment and relocation of crane elements (e.g., boom, counterweights, motor, etc.) on the carriage.

Another embodiment of the present invention uses the carriage and hoist motor as a portable power pack. For example, one end of the carriage can be attached by cable to a fixed member such as a building column, and the lifting cable attached to the hoist motor can be used to pull an object across the ground, a roof, a floor of a building, or other surface.

Thus, the mobile crane of the present invention provides a compact, portable, highly maneuverable, multifunction assembly that can replace a complex and costly ground or roof based crane.

BRIEF DESCRIPTION OF THE DRAWINGS

The features of the present invention will best be understood from a detailed description of the invention and a preferred embodiment thereof selected for the purposes of illustration and shown in the accompanying drawings in which.

DETAILED DESCRIPTION OF THE INVENTION

Figure 1:
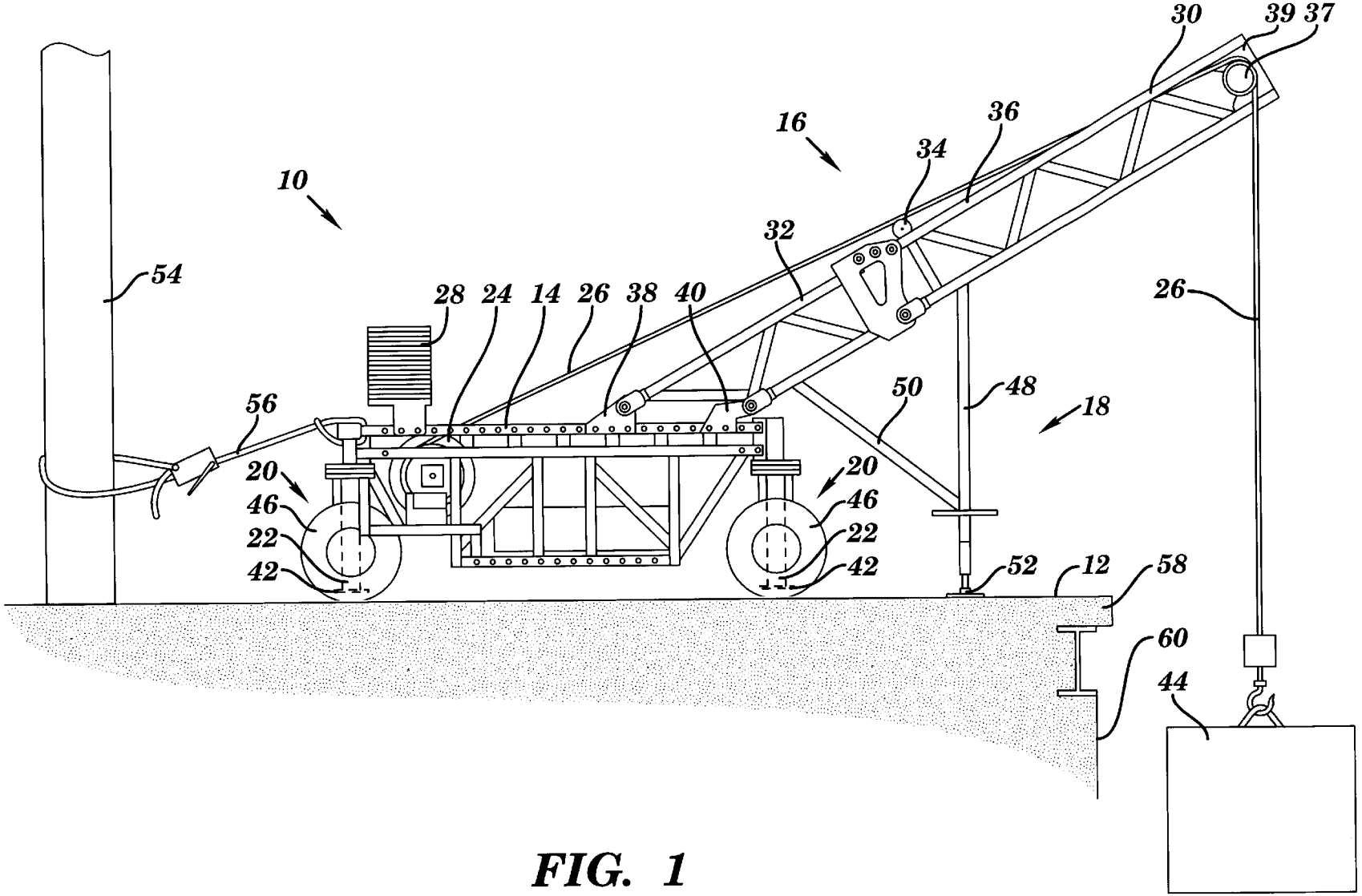
FIG. 1 is a side elevational view of a first embodiment of a mobile crane in accordance with the present invention in use on a roof.

Although certain preferred embodiments of the present invention will be shown and described in detail, it should be understood that various changes and modifications may be made without departing from the scope of the present invention. The scope of the present invention will in no way be limited to the number of constituting components, the materials thereof, the shapes thereof, the relative arrangement thereof, etc., and are disclosed simply as an example of the preferred embodiment. The features and advantages of the present invention are illustrated in detail in the accompanying drawings, wherein like reference numerals refer to like elements throughout the drawings.

Referring to FIG. 1, there is illustrated a side elevational view of a first embodiment of a mobile crane 10 in accordance with the present invention in position on a roof 12 of a building. The mobile crane 10 includes a carriage 14, a boom assembly 16, a boom support assembly 18, a plurality of wheel assemblies 20 each including at least one wheel, a hoist motor 24, a cable 26, and a counterweight 28. Although located on the roof 12 of a building in this example, it should be clear that the mobile crane 10 of the present invention can additionally be used on the ground, throughout the interior of the building, or on any floor of the building.

The boom assembly 16 includes an outer boom 30 and an inner boom 32. A cable sheave 34 is attached to a lower portion 36 of the outer boom 30. A cable sheave 37 is attached to the upper portion 39 of the outer boom 30. Boom mounting brackets 38 and 40 are used to attach the boom assembly 16 to the carriage 14. A first end of the cable 26 is attached to the hoist motor 24. The second end of the cable 26 is attached to a load 44. In operation, the hoist motor 24 retracts or extends the cable 26 in a manner known in the art to lift or lower the load 44 along the building face 60 or onto or off of the roof 12. The hoist motor 24 may be powered by any convenient means including, but not limited to, a hydraulic motor, an electric motor, or a fuel powered motor.

Figure 5:
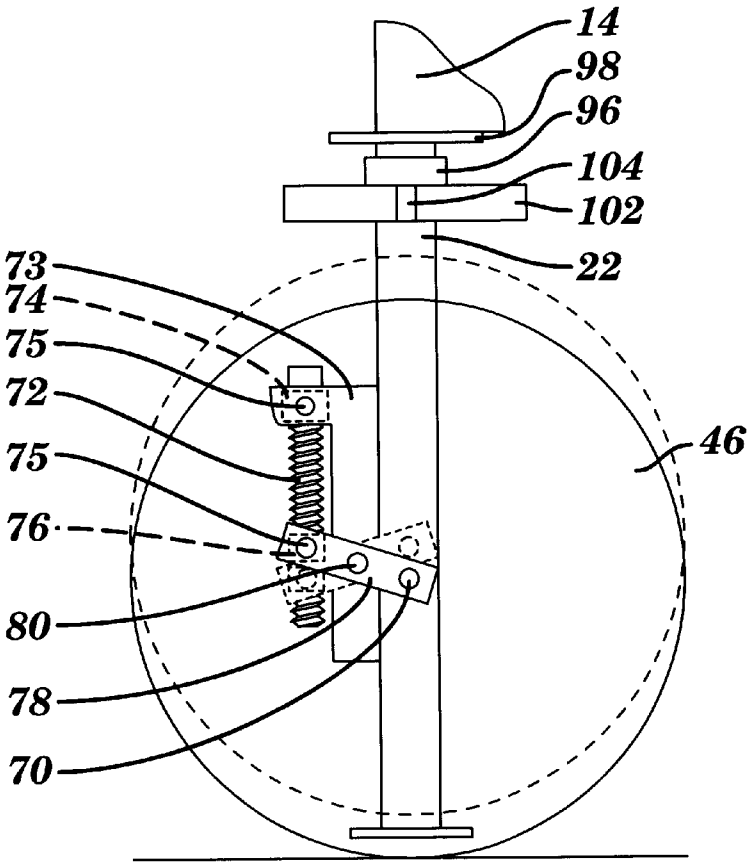
FIG. 5 is a partial side elevational view of the wheel retraction apparatus of FIG. 4.
Figure 4:
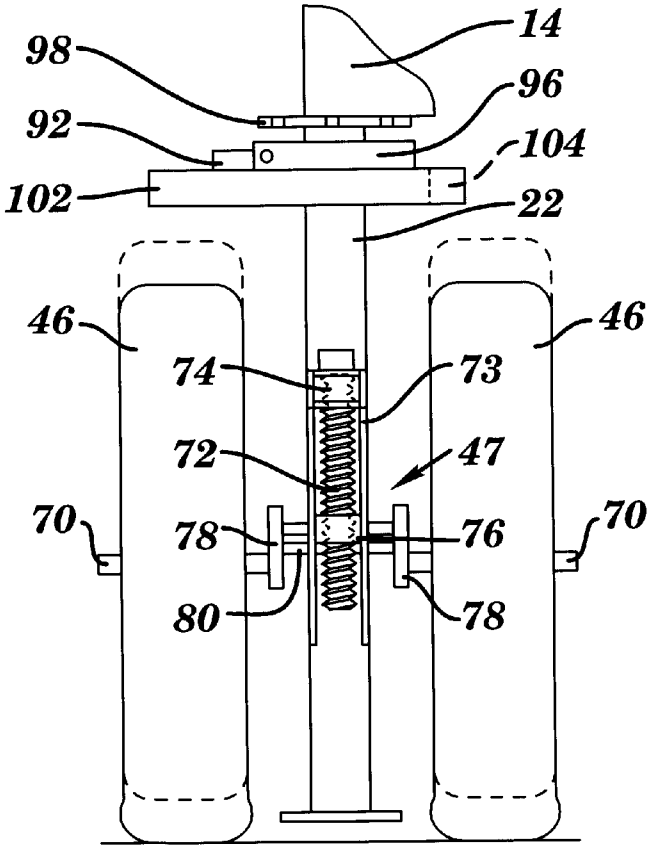
FIG. 4 is a partial front elevational view of the wheel retraction apparatus.

Each wheel assembly 20 includes a wheel 46 connected to a fixed length king pin housing support 22 through a wheel retraction apparatus 47 (FIGS. 4 and 5). The wheel retraction apparatus 47 is provided for retracting and extending the wheels 46 relative to the carriage 14.

The fixed length king pin housing supports 22 are used to support the weight of the carriage 14 when the wheels 46 are in a retracted state. Support pads 42 are attached to lower ends of the king pin housing supports 22. The upper ends of the king pin housing supports 22 are rotatably attached to the carriage 14. In operation, before the load 44 is lifted, the wheels 46 are preferably retracted toward the carriage 14, causing the carriage 14 to lower toward the roof 12, until the support pads 42 of the king pin housing supports 22 are in contact with the roof 12. As the wheels 46 are retracted further, the wheels 46 are lifted from the roof 12 and the carriage 14 is fully supported by the support pads 42 of the king pin housings 22.

The boom support assembly 18 includes a support leg 48, a support leg strut 50, and a boom support pad 52. When the mobile crane 10 is in position to lift the load 44, the boom support assembly 18 is attached to the boom assembly 16, and the boom support pad 52 is adjusted to contact the roof 12. Thus, when a load is lifted or lowered, a portion of the load of the boom assembly 16 is transferred to the roof 12, through the boom support assembly 18. The boom support assembly 18 shifts the fulcrum point from the front wheels 46 or the king pin housing supports 22 of the carriage 14 to a point between the carriage 14 and the upper portion 39 of the boom. The boom support assembly 18 increases the counterweight effectiveness of the carriage 14 such that a load of about 3500 pounds instead of about 650 pounds can be lifted by the mobile crane 10. This reduces the load supported by the carriage 14 and greatly reduces the tendency of the carriage 14 to tip toward the load 44. Also, the additional counterweight 28, attached to the end of the carriage 14 opposite the boom assembly 16, helps to prevent the carriage 14 from tipping toward the load 44. For additional safety, to prevent the carriage 14 from sliding toward the roof edge 58, a safety cable 56 can be attached between the carriage 14 and a building structural member 54 or other fixed support having sufficient strength.

Figure 2:
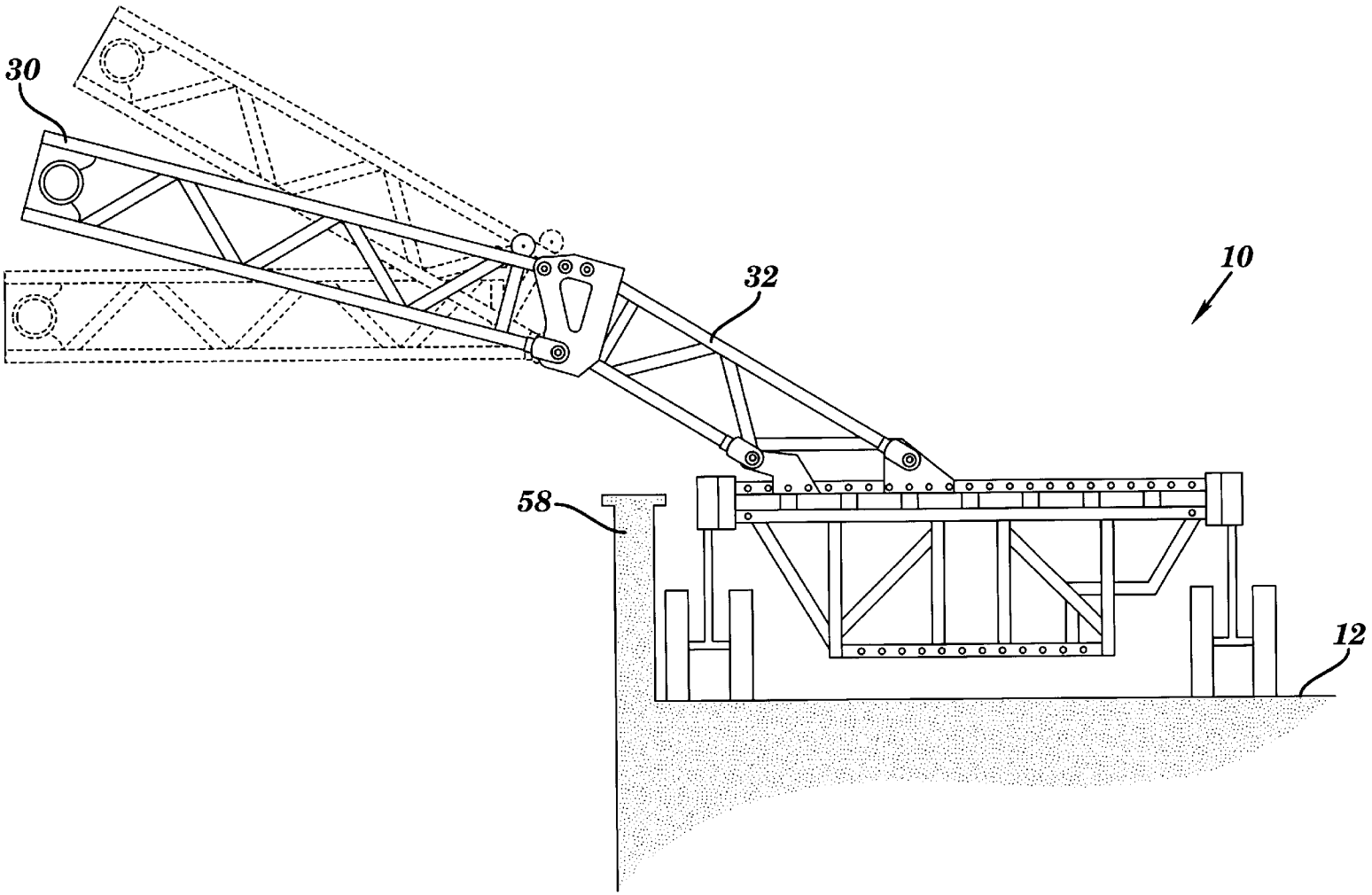
FIG. 2 is a side elevational view of the mobile crane illustrating the relative selectable positions of the outer boom.

FIG. 2 provides a side elevational view of the mobile crane 10, located on the roof 12, and near the roof edge 58. As shown, the outer boom 30 can be moved to a plurality of selectable angles relative to the inner boom 32. In FIG. 2 several possible positions of the outer boom 30 are illustrated in phantom.

Figure 3:
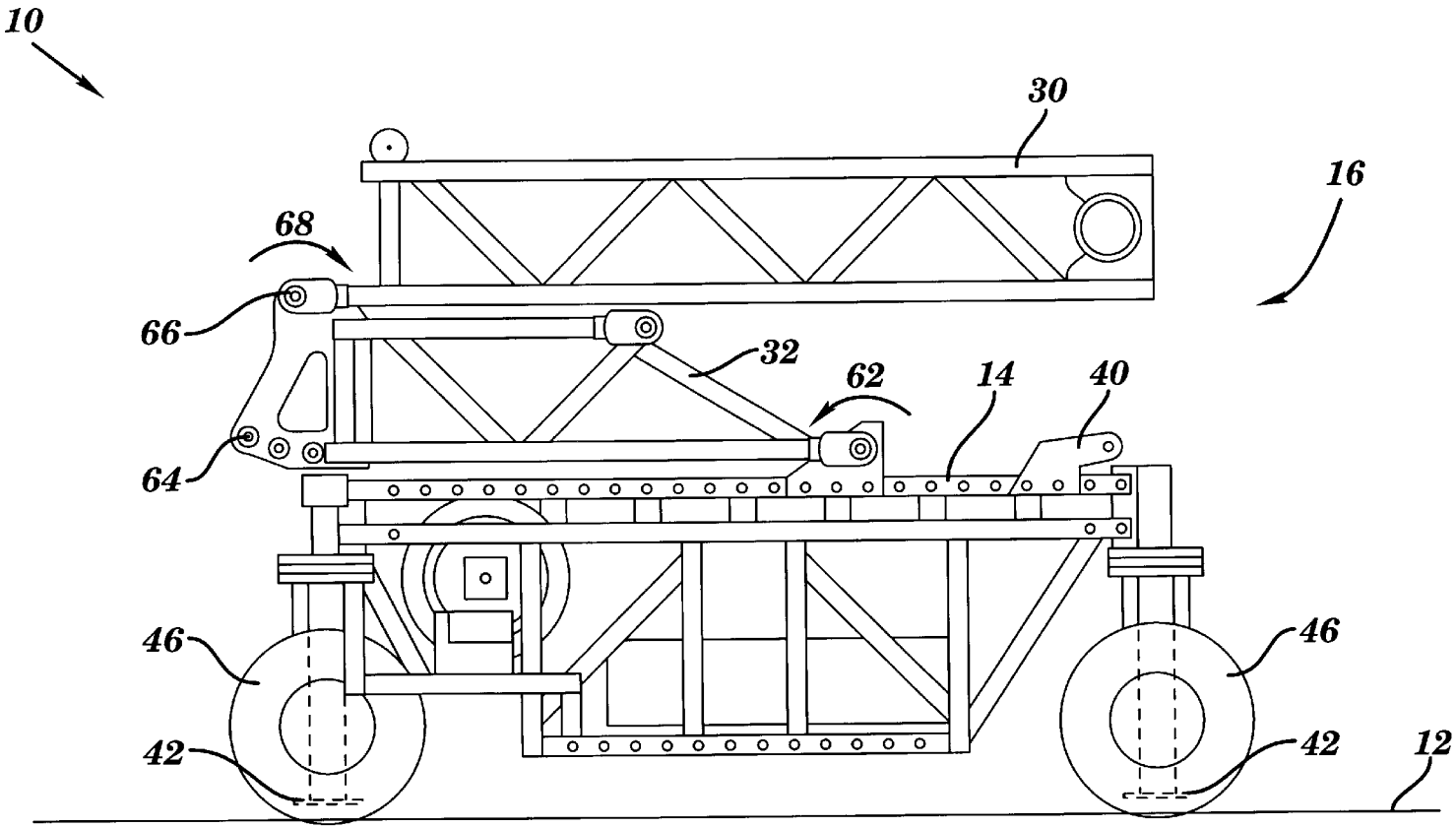
FIG. 3 is a side elevational view of the mobile crane with the boom in a folded transportable configuration.

FIG. 3 illustrates the mobile crane 10 with the boom assembly 16 in a folded transportable configuration. The boom assembly 16 is converted from the extended configuration shown in FIG. 1 to the folded configuration shown in FIG. 3 in a number of steps. First, the boom support assembly 18, if attached, is removed from the boom assembly 16. Next, the inner boom 32 is released from the boom mounting bracket 40 and is rotated in a counterclockwise direction 62 until the inner boom 32 rests against the carriage 14. The outer boom 30 is then released from a lower carriage pin location 64 and is rotated in a clockwise direction 68 about a connecting pin 66, until the outer boom 30 rests on the inner boom 32. The wheels 46 are extended away from carriage 14 by the wheel retraction apparatuses 47 until the wheels 46 contact the roof 12 and lift the support pads 42 of the king pin housing supports 22 away from the roof 12. At this point, the mobile crane 10 is in a compact folded configuration and can be easily moved across the roof 12, into a building elevator, or to another work location. Preferably, the mobile crane 10 of the present invention, when folded as described above, has overall dimensions of about 4 feet wide by 8 feet long by 5 feet high. Advantageously, this allows the mobile crane 10 to fit into most standard size building freight/construction elevators. The above process may be reversed to set up the mobile crane 10.

The features of the wheel retraction apparatus 47 are illustrated in greater detail in FIGS. 4 and 5. FIG. 4 provides a partial front elevational view of the wheel retraction apparatus 47, while FIG. 5 provides a partial side elevational view of the wheel retraction apparatus 47 with one wheel 46 removed for clarity. Phantom dotted lines indicate the movement of the wheels 46 from extended to retracted locations.

The wheel retraction apparatus 47 includes wheel axles 70 for rotatably supporting the wheels 46, jack screw 72, trunnion block 74, trunnion nut 76, axle arm 78, and axle arm shaft 80. A bracket 73 is fixed to, or integrally formed with, the king pin housing support 22. The trunnion block 74 is rotatably attached to the bracket 73 using bolts 75 or other suitable hardware. A first end of the jack screw 72 passes through and is rotatably attached to the trunnion block 74. The second end of the jack screw 72 is threadedly attached to the axle arm 78 by the trunnion nut 76. Again, the trunnion nut 76 is rotatably attached to the axle arm 78 using bolts 75 or other suitable hardware.

Figure 6:
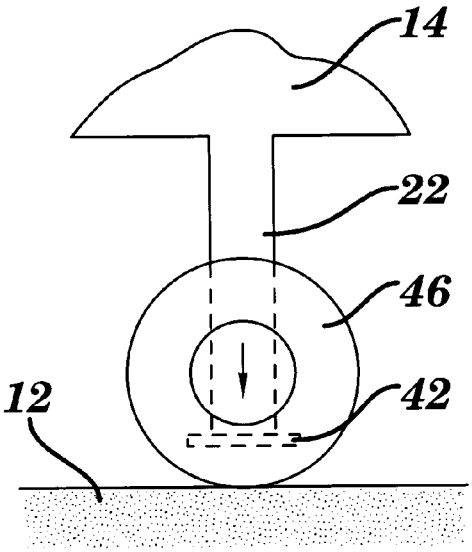
FIG. 6 is a partial side elevational view of a wheel in a downward rolling position.
Figure 7:
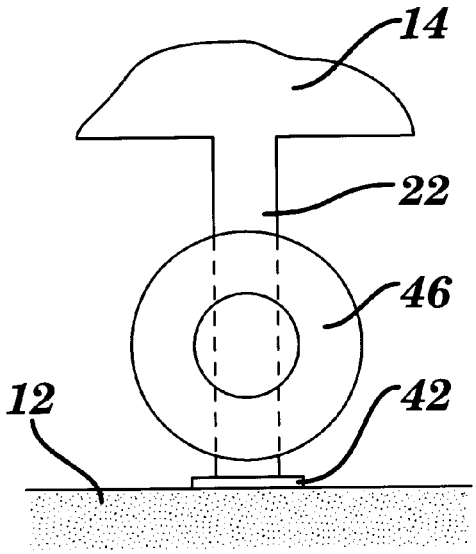
FIG. 7 is a partial side elevational view of a wheel in a retracted position allowing a king pin housing support to contact the ground and support the mobile crane.

The axle arm 78 pivots about the axle shaft 80 in response to the rotation of the jack screw 72. For example, when the jack screw 72 is rotated in a first direction such that the trunnion nut 76 and the axle arm 78 are displaced in an upward direction, the wheel axles 70 and associated wheels 46 on the other end of the axle arm 78 are displaced away from the carriage 14 in a downward direction. As shown in FIG. 6, this causes the wheels 46 to engage the roof 12, thereby lifting the king pin housing support 22 and attached support pad 42 away from the roof 12. Correspondingly, when the jack screw 72 is rotated in a second, opposing direction, the trunnion nut 76 and the axle arm 78 are displaced in a downward direction, thereby displacing the wheel axles 70 and associated wheels 46 on the other end of the axle arm 78 toward the carriage 14 in an upward direction. As shown in FIG. 7, this action displaces the wheels 46 toward the carriage 14 until the support pad 42 on the king pin housing support 22 engages the roof 12.

Thus, the wheel retraction assembly 47 moves the wheels in an upward or downward direction relative to the king pin housing support 22. Further, since the king pin housing support 22 is of a fixed length, the carriage 14 can be selectively supported by the wheels 46 to allow the mobile crane 10 to be moved from location to location, or by the support pads 42 on the king pin housing supports 22 to provide crane lifting stability.

Figure 8:
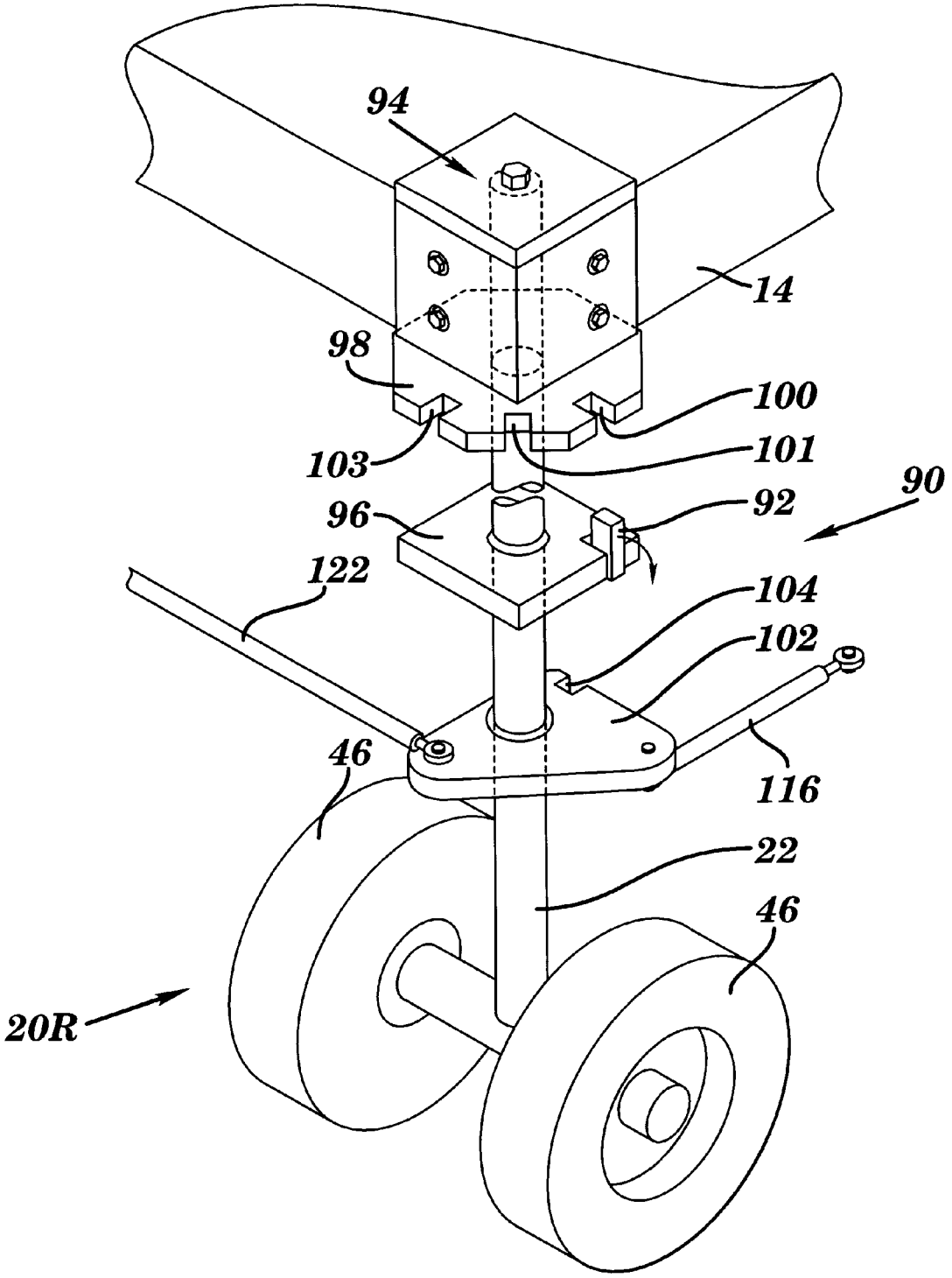
FIG. 8 is an exploded perspective view of a wheel steering apparatus for one wheel assembly.

FIG. 8 is an exploded perspective view of a wheel steering apparatus 90 for a rear wheel assembly 20R of the mobile crane 10. Each rear wheel assembly 20R is provided with a similar steering apparatus 90. Also shown are a king pin housing support 22 and a portion of the carriage 14. The king pin housing support 22 is rotatably attached to the carriage 14 by a king pin mounting assembly 94. Additional views of the components of the wheel steering apparatus 90 are provided in FIGS. 4 and 5.

Three modes of wheel positioning can be selected using a single control element 92. The control element 92 is pivotally attached to a selector plate 96. The selector plate 96 is rigidly attached to the king pin housing support 22 so that any rotation of the selector plate 96 causes a direct rotation of the king pin housing support 22.

A direction control plate 98 is rigidly attached to the carriage 14. The direction control plate 98 includes a plurality of fixed notches 100, 101, and 103 that are configured to selectively receive the control element 92 to control the orientation of the wheels 46. Although three fixed notches 100, 101, and 103 are shown, it should be clear that any number of fixed notches may be employed. Also, the orientation of the fixed notches may be adjusted to provide specific wheel directions. A rear steering arm 102 includes a notch 104 for selectively receiving the control element 92 to activate four wheel steering. A rear steering tie rod 116 and a rear transfer tie rod 122 are pivotally attached to the rear steering arm 102. Each front and rear wheel assembly 20F and 20R of the mobile crane 10 includes at least the control element 92, selector plate 96, and the direction control plate 98.

Figure 9:
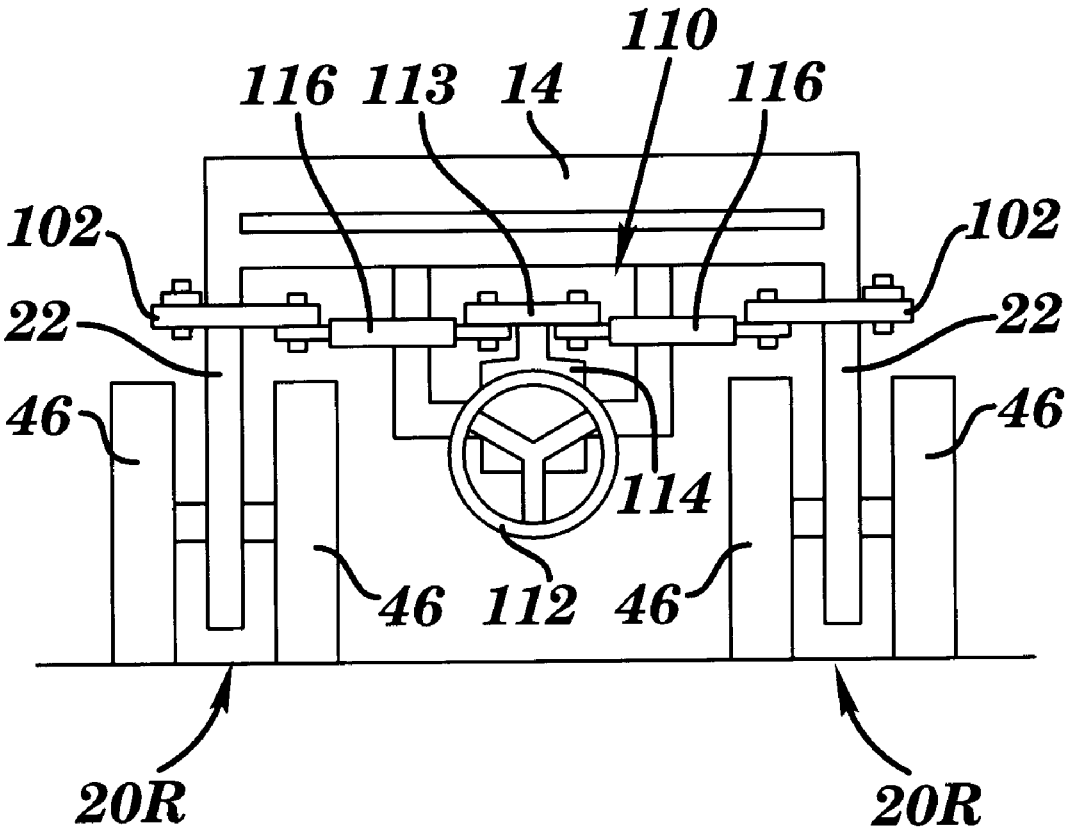
FIG. 9 is a rear elevational view of a wheel steering apparatus of the mobile crane.
Figure 10:
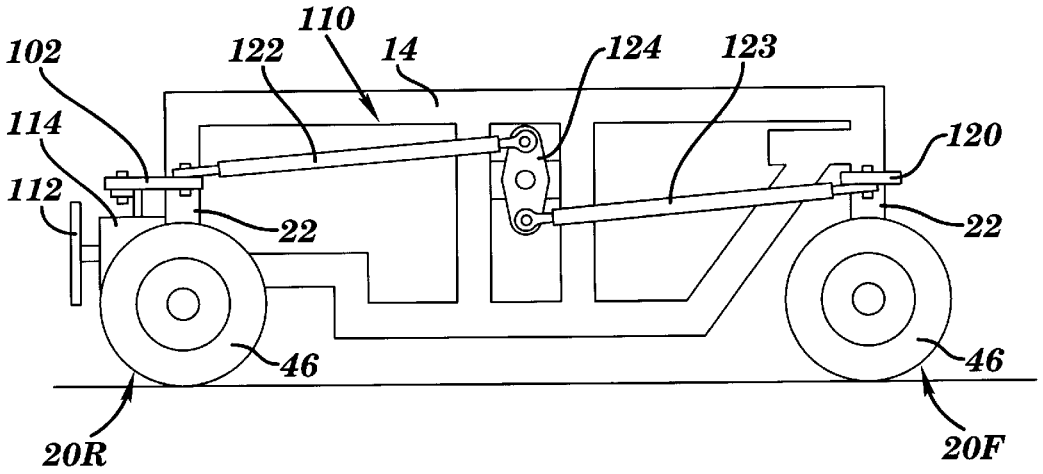
FIG. 10 is a side elevational view of the wheel steering apparatus.
Figure 11:
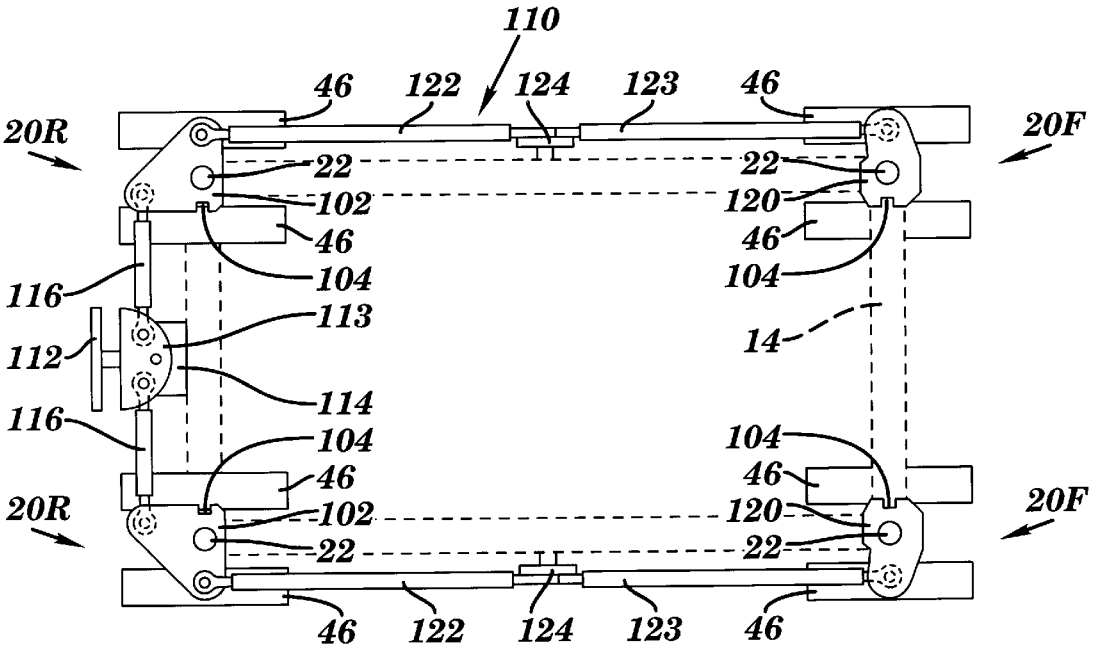
FIG. 11 is a plan view of the wheel steering apparatus.

In a first mode of wheel positioning, the control element 92 is pivoted to engage the notch 104 in the rear steering arm 102 (see also FIGS. 9, 10 and 11). This activates a four wheel steering mode. In the four wheel steering mode, the steering tie rod 116 provides rotary motion to the rear steering arm 102 which in turn rotates the king pin housing 22 and the wheels 46. As further illustrated in FIGS. 9, 10, and 11, the rotary motion of the rear steering arm 102 additionally imparts a rotary motion to a corresponding front steering arm 120 through a linkage assembly.

In a second mode of wheel positioning, the control element 92 is rotated to engage a notch 100, 101, or 103 in the direction control plate 98. This causes the wheels 46 to be pointed and locked in a specific direction. For example, notch 100 will provide wheel alignment for a sideways direction, notch 103 will provide a straight forward or backward direction, and notch 101 will provide a wheel alignment causing rotation of the carriage 14 about its center.

In a third mode of wheel positioning, the control element 92 is rotated and secured in a direction parallel to the selector plate 96 as shown in FIG. 4, allowing the king pin housing support 22 and the wheels 46 to swivel and rotate in any direction.

The wheels 46 can be provided with a power source (not shown) to turn each wheel 46 individually. Also, the wheels 46 can be provided with a brake system (not shown) to stop/prevent the wheels 46 from turning.

FIGS. 9, 10 and 11 illustrate the wheel steering apparatus 110 of the mobile crane 10 in the four wheel steering mode. The steering apparatus 110 includes a steering wheel 112, a steering gearbox 114, a steering arm 113, steering tie rods 116, rear steering arms 102, front steering arms 120, rear transfer tie rods 122, front transfer tie rods 123, and transfer arms 124.

The rear steering arms 102 and the front steering arms 120 are engaged in the four wheel steering mode by rotating and securing each of the control elements 92 in a corresponding notch 104. Referring to FIG. 11, when the notches 104 on the front and rear control arms 120, 102 are engaged by the control elements 92, the steering apparatus 110 is connected to the king pin housing supports 22 of the two front wheel assemblies 20F and the two rear wheel assemblies 20R, thereby allowing a user to simultaneously control the directional positions of wheel assemblies 20F and 20R.

Wheel direction in the four wheel steering mode is controlled by the steering wheel 112. Specifically, a clockwise or counterclockwise rotation of the steering wheel 112 results, via the steering gearbox 114, in a corresponding rotation of the steering arm 113 in a counterclockwise or clockwise direction. The steering arm 113 pulls/pushes the steering tie rods 116 which in turn cause rotation of the rear steering arms 102 and displacement of the rear transfer tie rods 122 in a first direction. The displacement of the rear transfer tie rods 122 causes a rotation of the transfer arms 124, a reverse displacement of the front transfer tie rods 123, and a rotation of the front steering arms 120 in a direction opposite to that of the rear steering arms 102. Thus, the steering apparatus 110 provides an automatic synchronous turning motion such that as the rear steering arms 102 rotate in a clockwise direction, the front steering arms 120 simultaneously rotate in a counterclockwise direction. Similarly, when the rear steering arms 102 rotate in a counterclockwise direction, the front steering arms 120 rotate in a clockwise direction.

Figure 12:
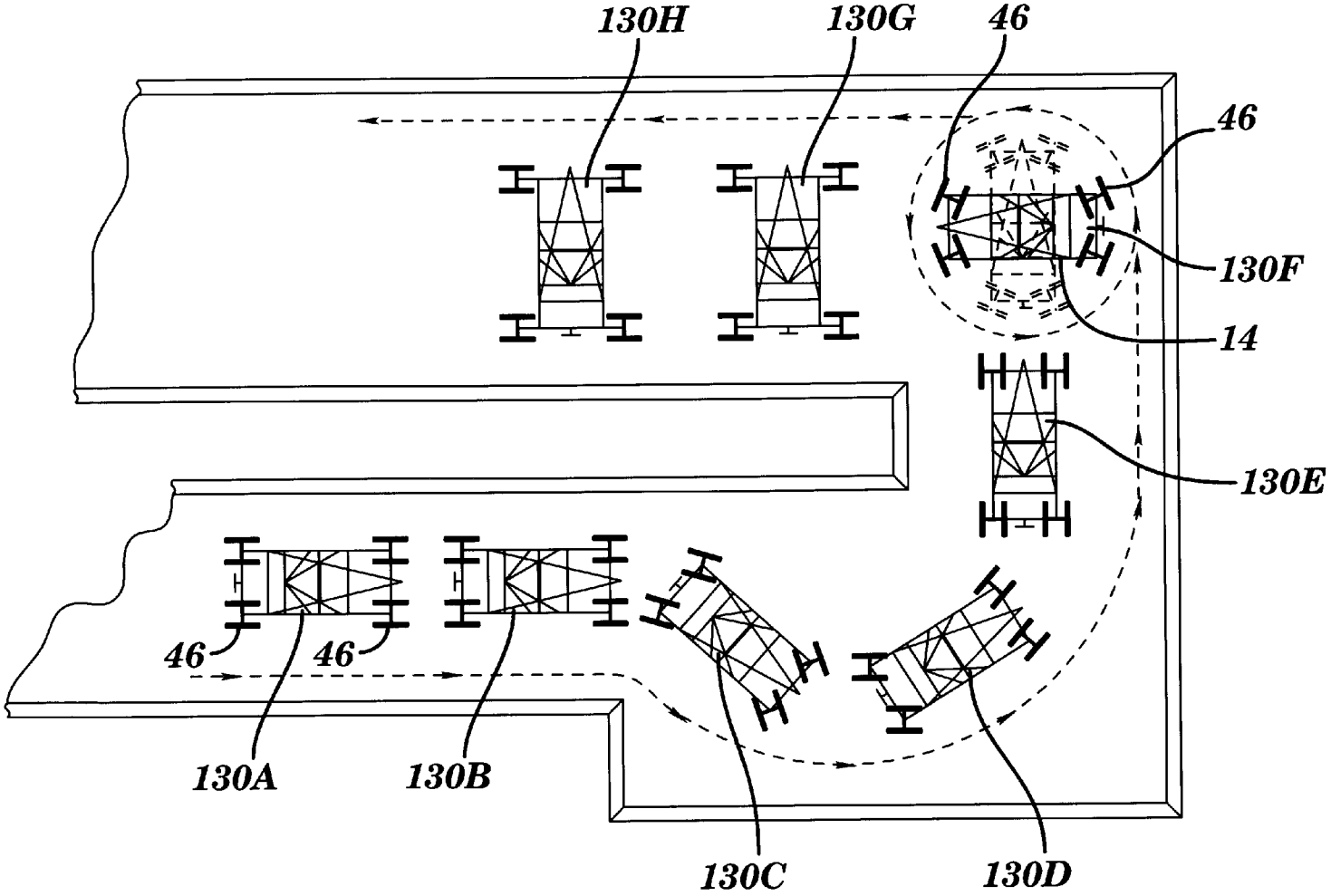
FIG. 12 illustrates the multi-directional steering modes available to the mobile crane of the present invention.

FIG. 12 is a plan view showing the steering modes available for providing multi-directional movement of the mobile crane 10. For specific direction control, the control element 92 in each wheel assembly 20 is engaged in one of the notches 100, 101, and 103 in the direction control plate 98. In FIG. 12, position 130A shows the wheels 46 locked in a straight forward position, position 13OF shows the wheels 46 locked in a position causing rotation of the carriage 14 about its center, and positions 130G and 130H show the wheels 46 locked in a position for sideways motion. The four wheel steering mode provided by the steering apparatus 110 is illustrated in positions 130E, 130C, 130D and 130E.

Figure 13:
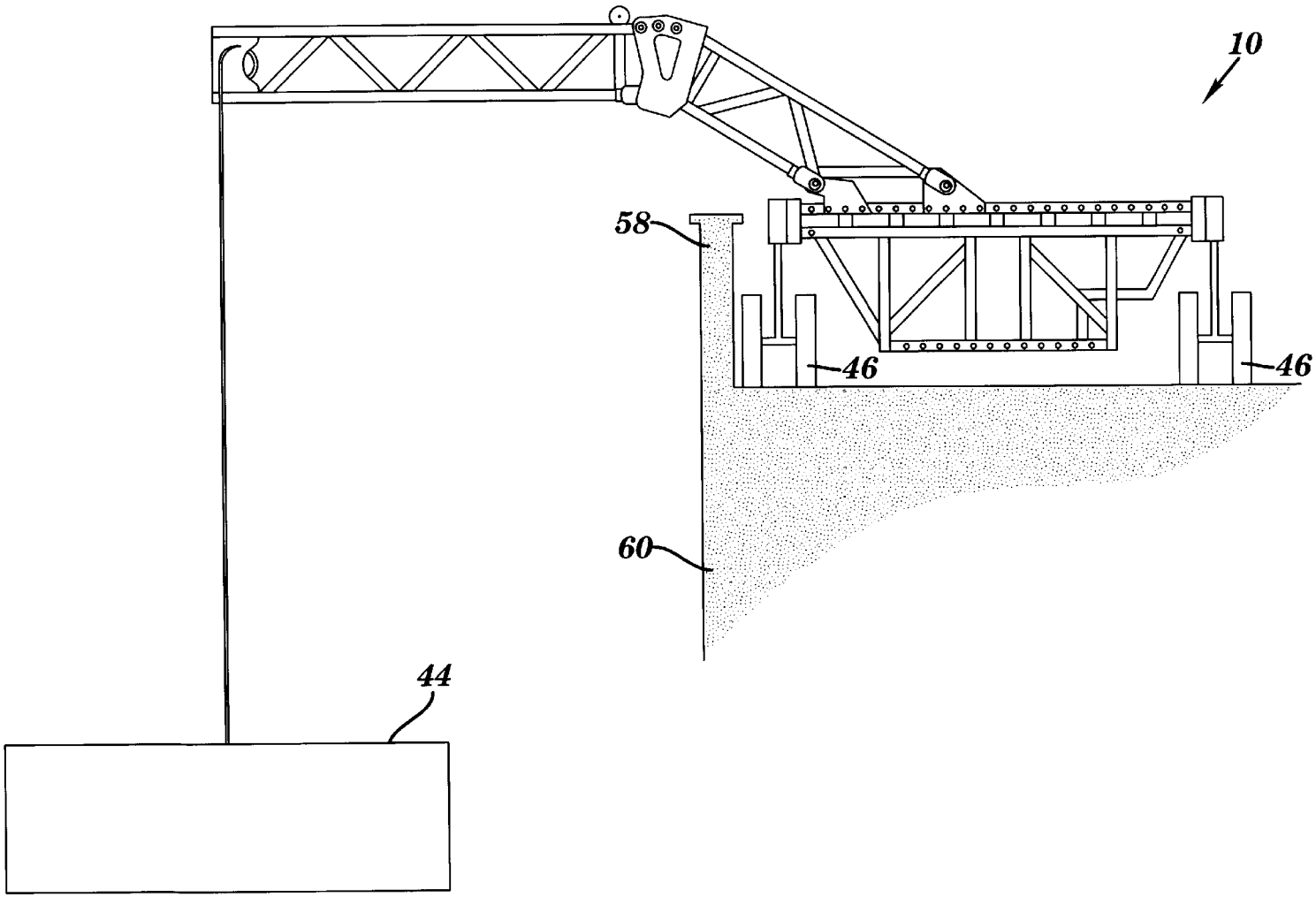
FIG. 13 is a side elevational view showing the wheel positions that allow movement of the mobile crane parallel to a roof edge.

FIG. 13 is a side elevational view of the mobile crane 10 wherein the wheels 46 are arranged in positions that allow movement of the mobile crane 10 parallel to a roof edge 58. In this configuration, the mobile crane 10 of the present invention can be used to move a load 44 along a building face 60.

Figure 14:
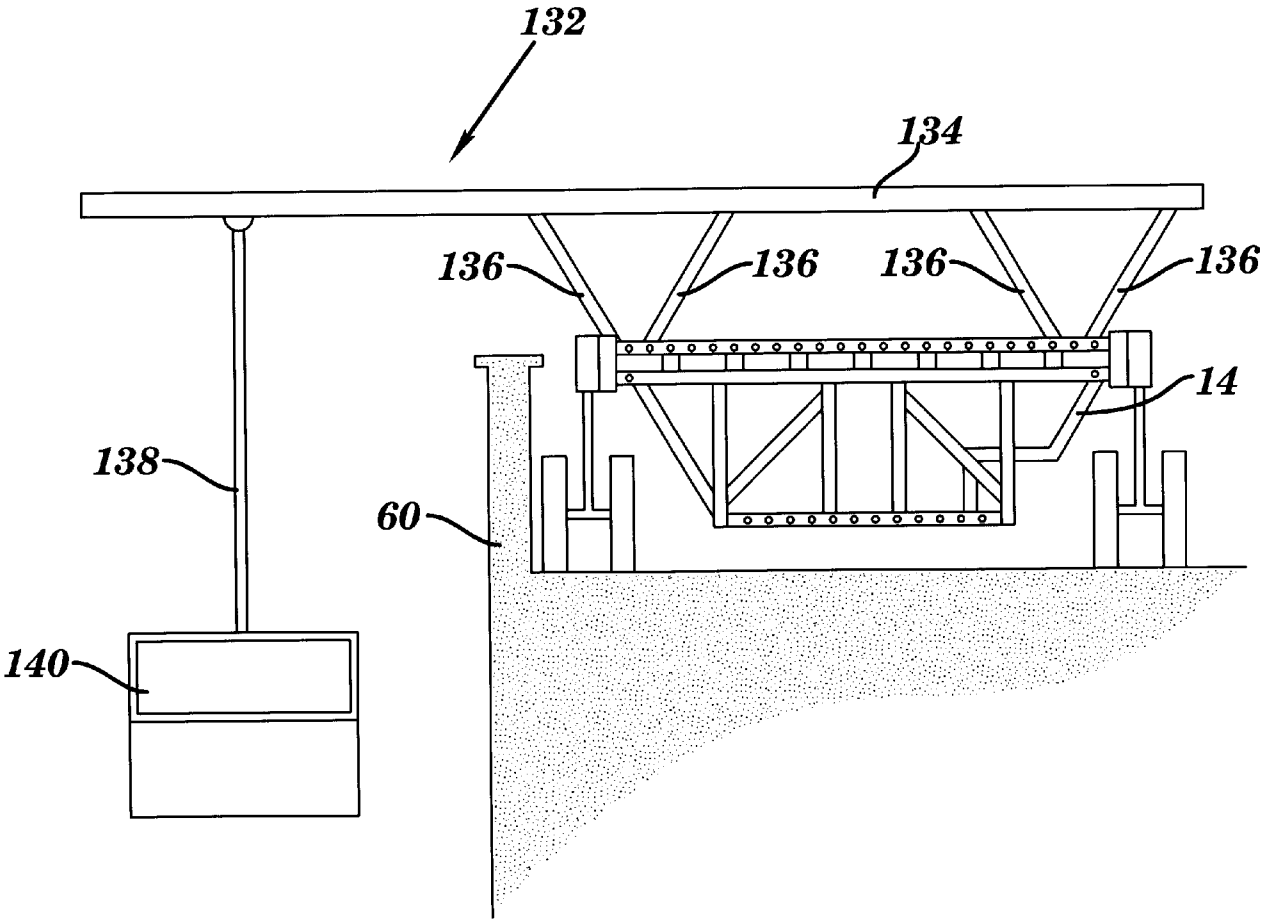
FIG. 14 is a side elevational view showing a work platform system supported by rigid booms attached to the mobile carriage.

FIG. 14 is a side elevational view illustrating another embodiment of the mobile crane 10. In this embodiment, a work platform system 132 is attached to the carriage 14 of the mobile crane 10. The work platform system 132 includes a plurality of booms 134, boom support struts 136 for attaching the booms to the carriage 14, and platform cables 138 for raising and lowering a work platform 140. Also, the booms 134 can be attached to a plurality of adjacent carriages 14 which may or may not be connected together. The work platform 140 can be moved horizontally along the building face 60 as described with regard to FIG. 13, and can be raised or lowered along the building face 60.

Figure 17:
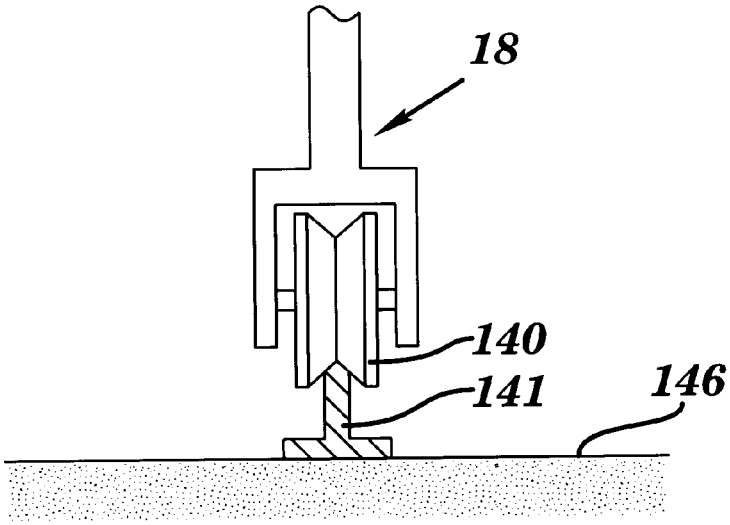
FIG. 17 is a side cross-sectional view of the grooved wheel and rail.
Figure 15:
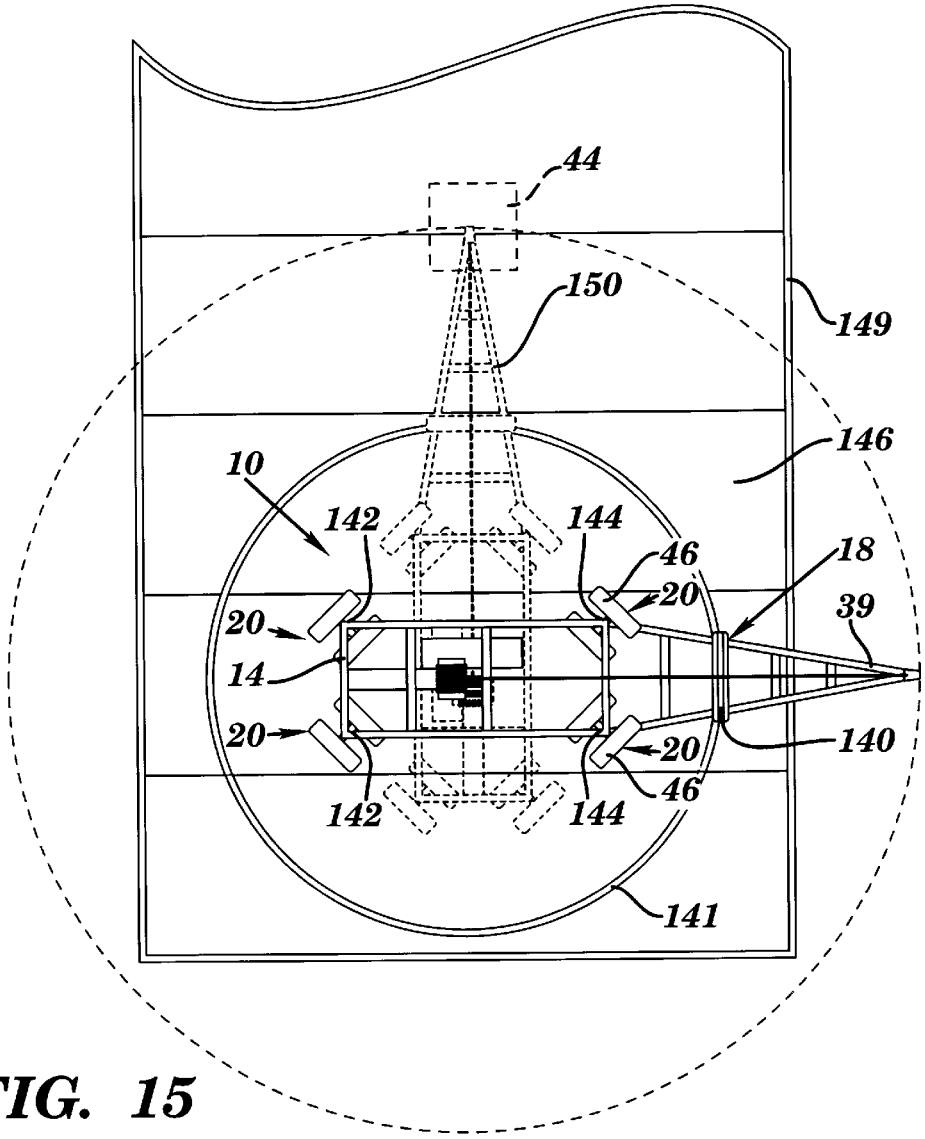
FIG. 15 illustrates the turreting motion of the mobile crane.
Figure 16:
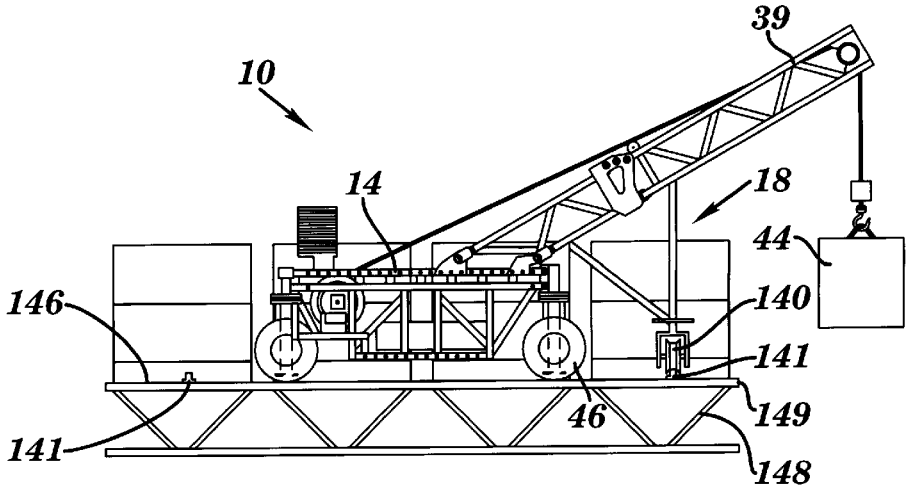
FIG. 16 is a side elevational view of the circular rail system.

FIGS. 15, 16 and 17 illustrate another embodiment of the mobile crane 10 in accordance with the present invention. In this embodiment, the boom support assembly 18 includes a grooved wheel 140 guided by a circular rail 141. In this mode of operation, the wheel assemblies 20 at locations 142 are locked in a position for rotation of the carriage 14 about its center, while the wheel assemblies 20 at locations 144 are in the wheel positioning mode allowing the wheel assemblies 20 to freely swivel and rotate in any direction.

The circular rail 141 not only guides the mobile crane 10, but also spreads the weight of the load 44 supported by the boom support assembly 18 over a larger area of the floor 146 of a structure 148. Further, the boom support assembly 18 and the circular rail 141, shift the fulcrum point from the front wheels 46 of the carriage 14 to a point between the carriage 14 and the upper portion 39 of the boom. The boom support assembly 18 increases the counterweight effectiveness of the carriage such that a load of about 3500 pounds instead of about 650 pounds can be lifted by the mobile crane. In this embodiment, the mobile crane 10 can lift the load 44 to the top of the structure 148, and can then swing the load 44 to a position 150 over the floor 146 of the structure 148 as shown in a phantom in FIG. 15.

The circular rail 141 may take other forms, such as a straight rail to provide guidance parallel to the side 149 of the structure 148 or perpendicular to the side 149 of the structure 148.

Figure 19:
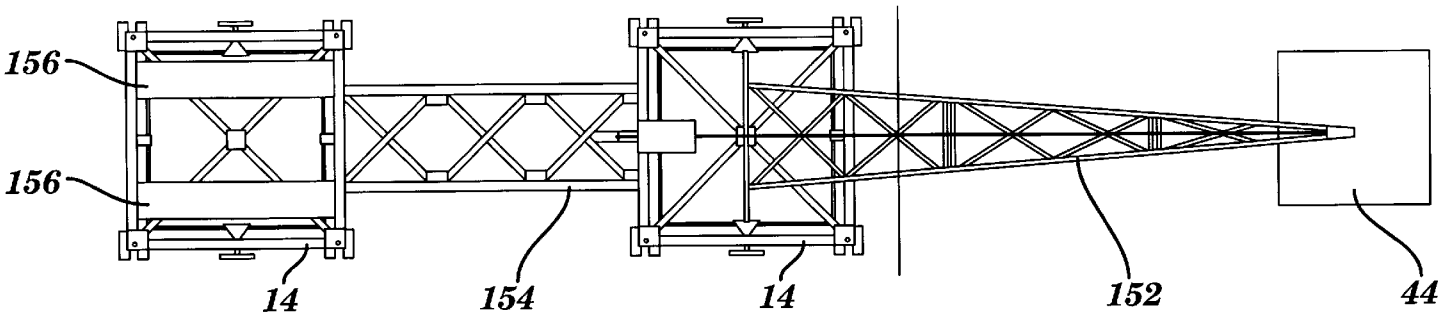
FIG. 19 is a plan view of two carriages connected together to provide support for a large boom.
Figure 18:
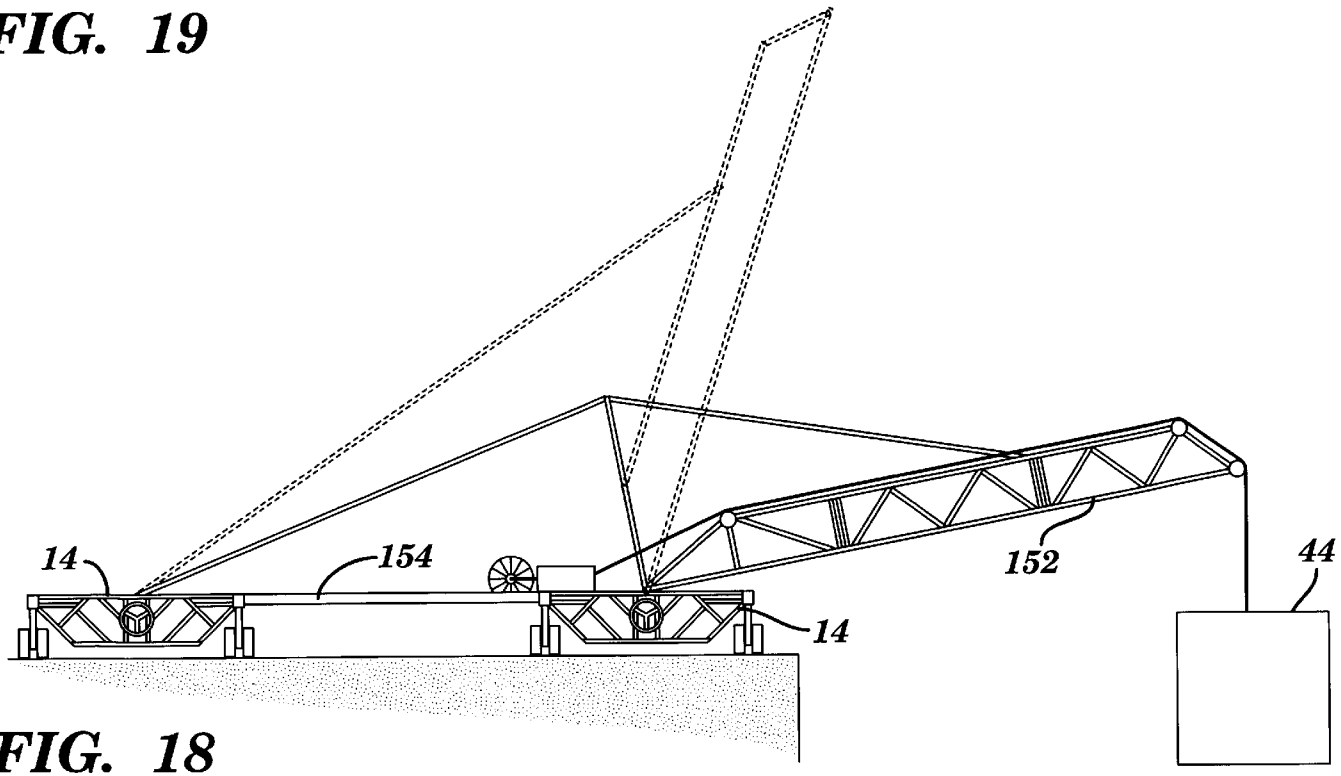
FIG. 18 is a side elevational view of two carriages connected together to provide support for a large boom.

FIGS. 18 and 19 illustrate another embodiment of the present invention, where two carriages 14 are connected together by a coupling assembly 154 to support a large boom 152. This embodiment allows a larger load 44 to be lifted. The boom 152 can be raised and lowered as shown in phantom in FIG. 18. A counterweight 156 can be attached to the carriage 14 that is the farthest away from the boom 152.

Figure 20:
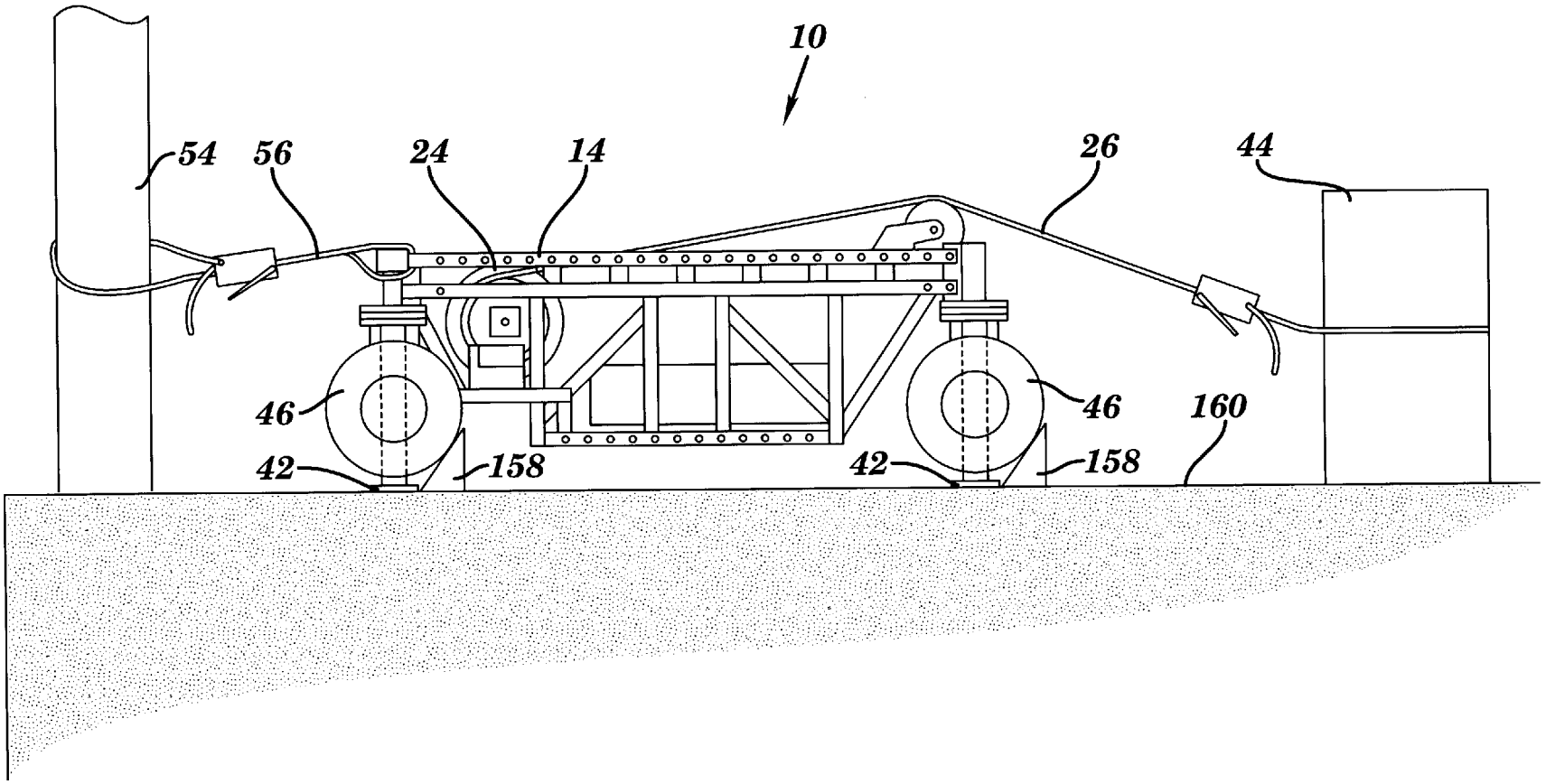
FIG. 20 is a side elevational view of a carriage configured to pull a load across a surface.

Another embodiment of the present invention, as shown in FIG. 20, includes the carriage 14 and the hoist motor 24 of the mobile crane 10. This embodiment uses the mobile crane 10 as a portable power pack to supply a force to pull loads 44 across a surface 160. In this embodiment, the boom assembly 16 has been removed from the carriage 14, and the wheels 46 have been retracted so that the carriage 14 is supported on the support pads 42. Wheel chocks 158 have been placed against the wheels 46 to prevent the carriage 14 from moving sliding the surface. A safety cable 56 can be attached between the carriage 14 and a building structural member 54 or other fixed support. The cable 26, attached between the hoist motor 24 and the load 44, provides a pulling force for pulling the load 44 across the surface 160.

Figure 22:
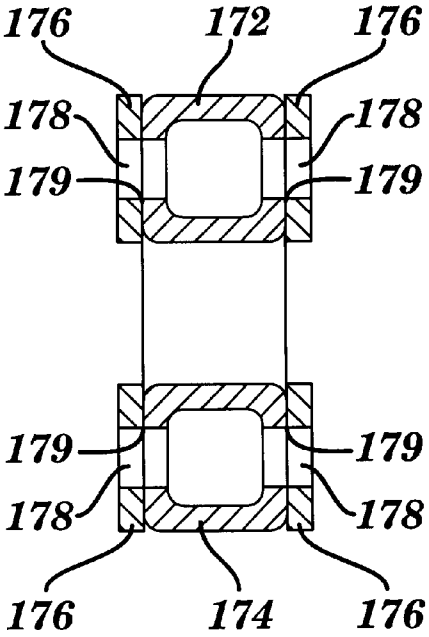
FIG. 22 is a cross-sectional view taken along line 22–22 of FIG. 21.
Figure 21:
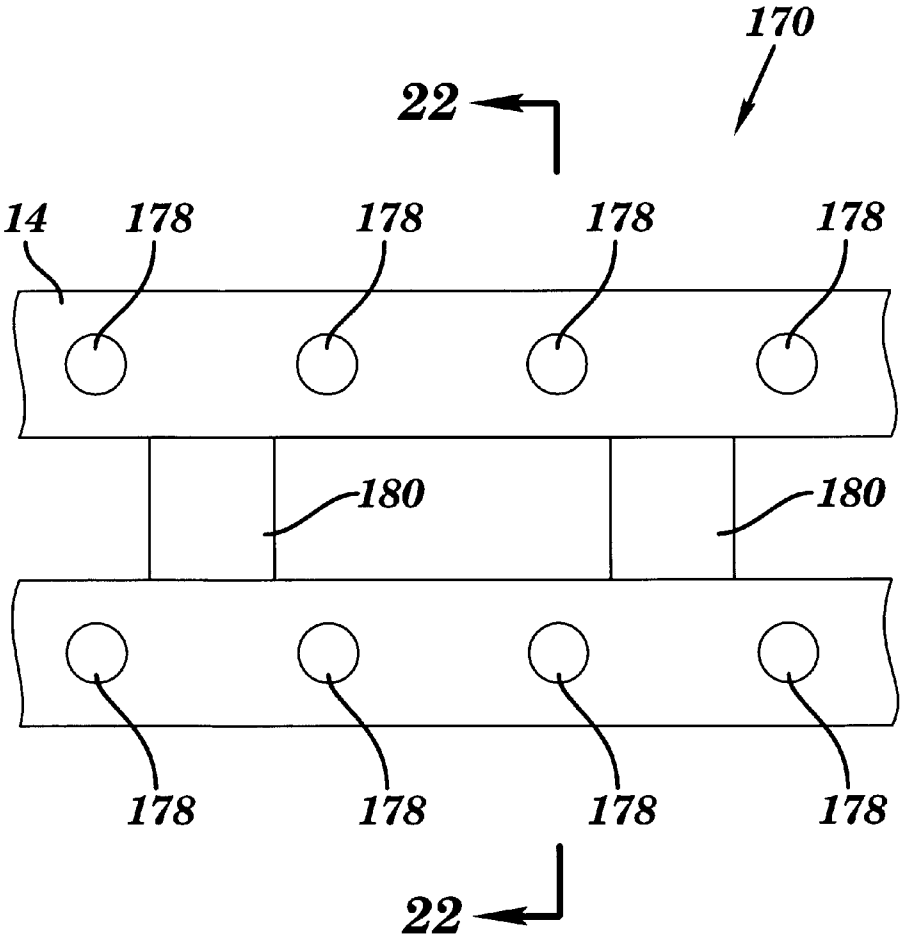
FIG. 21 is a side elevational view of a frame member of the carriage.

FIGS. 21 and 22 show a section of the frame assembly 170 of the carriage 14. The frame assembly 170 includes an upper frame member 172, a lower frame member 174, side plates 176, holes 178, and frame connector members 180. The frame assembly 170 has many useful features, including a plurality of equally spaced holes 178. Such holes are illustrated, for example, in various frame members of the embodiments of the mobile crane 10 illustrated in FIGS. 1, 3, and 20. The use of the plurality of equally spaced holes 178 provides convenient attachment locations for a variety of assemblies, including, but not limited to, one or more boom assemblies, a counterweight assembly, or a work platform assembly. Increased strength and stiffness is provided by the frame connector members 180 which are welded between the upper frame member 172 and the lower frame member 174, and the side plates 176 which are welded on the sides of the upper frame member 172 and the lower frame member 174. As illustrated in FIG. 22, the use of the side plates 176 increases the bearing surface 179 of the frame member, preventing tearing and deformation caused by pin loads in the holes 178.

The foregoing description of the present invention has been presented for purposes of illustration and description. It is not intended to be exhaustive or to limit the invention to the precise form disclosed, and many modifications and variations are possible in light of the above teaching. Such modifications and variations that may be apparent to a person skilled in the art are intended to be included within the scope of this invention as defined by the accompanying claims.

We claim:

1. A mobile crane comprising:

a carriage;

a plurality of wheel assemblies attached to the carriage, each wheel assembly including a control system for selecting a wheel positioning mode of the wheel assembly;

a boom attached to the carriage;

a plurality of fixed length carriage support legs attached to the carriage;

a cable passing over the boom with a first end of the cable attachable to a load;

a hoist motor connected to a second end of the cable for providing a force for lifting the load;

wherein the control system of each wheel assembly includes a control element for selecting a wheel positioning mode of the wheel assembly; and wherein:

in a first position, the control element of each wheel assembly selects a wheel positioning mode wherein the wheel assembly is controlled by a steering apparatus;

in a second position, the control element of each wheel assembly selects a wheel positioning mode wherein the wheel assembly is positioned in a fixed direction; and in a third position, the control element of each wheel assembly selects a wheel positioning mode wherein the wheel assembly can freely swivel in any direction.

2. The mobile crane according to claim 1, wherein the boom is foldable.

3. The mobile crane according to claim 2, wherein, with the boom folded, the mobile crane has overall dimensions of about four feet wide by about eight feet long by about five feet high.

4. The mobile crane according to claim 1, further including a counterweight for counterbalancing the load.

5. The mobile crane according to claim 1, further including a boom support for shifting a fulcrum point of the mobile crane to provide additional load lifting capacity.

6. The mobile crane according to claim 5, further including a plurality of wheels attached to the boom support, and guided by a circular track allowing the mobile crane to rotate in a turreting motion.

7. The mobile crane according to claim 1, wherein the carriage includes a plurality of evenly spaced holes for providing attachment locations.

8. The mobile crane according to claim 1, further including a plurality of carriages connected together.

9. The mobile crane according to claim 1, further including a motive power system for displacing the mobile crane.

10. The mobile crane according to claim 1, further including a braking system for stopping and preventing displacement of the mobile crane.

11. The mobile crane according to claim 1, wherein the fixed direction is parallel to a longitudinal axis of the carriage.

12. The mobile crane according to claim 1, wherein the fixed direction is perpendicular to a longitudinal axis of the carriage.

13. The mobile crane according to claim 1, wherein the fixed direction provides rotatable motion about a center of the carriage.

14. The mobile crane according to claim 1, wherein the steering apparatus further includes a steering wheel for controlling a direction of travel of the mobile crane.

15. The mobile crane according to claim 1, further including a system for retracting the plurality of wheel assemblies to support the mobile crane on the fixed length carriage support legs.

16. A mobile crane comprising:

a carriage;

a plurality of wheel assemblies attached to the carriage, each wheel assembly including a control system for selecting a wheel positioning mode of the wheel assembly;

a work platform system attached to the carriage;

at least one cable for raising and lowering a work platform along the face of a structure;

a plurality of fixed length carriage support legs attached to the carriage;

wherein the control system of each wheel assembly includes a control element for selecting a wheel positioning mode of the wheel assembly; and wherein in a first position, the control element of each wheel assembly selects a wheel positioning mode wherein the wheel assembly is controlled by a steering apparatus;

in a second position, the control element of each wheel assembly selects a wheel positioning mode wherein the wheel assembly is positioned in a fixed direction; and in a third position, the control element of each wheel assembly selects a wheel positioning mode wherein the wheel assembly can freely swivel in any direction.

17. The mobile crane according to claim 16, wherein the fixed direction is parallel to the longitudinal axis of the carriage.

18. The mobile crane according to claim 16, wherein the fixed direction is perpendicular to a longitudinal axis of the carriage.

19. The mobile crane according to claim 16, wherein the steering apparatus further includes a steering wheel for controlling a direction of travel of the mobile crane.

20. The mobile crane according to claim 16, further including a system for retracting the plurality of wheel assemblies to support the mobile crane on the fixed length carriage support legs.

21. The mobile crane according to claim 16, further including a plurality of carriages connected together.

22. An apparatus comprising:

a carriage;

a plurality of wheel assemblies attached to the carriage, each wheel assembly including a control system for selecting a wheel positioning mode of the wheel assembly;

wherein the control system of each wheel assembly includes a control element for selecting a wheel positioning mode of the wheel assembly; and wherein:

in a first position, the control element of each wheel assembly selects a wheel positioning mode wherein the wheel assembly is controlled by a steering apparatus;

in a second position, the control element of each wheel assembly selects a wheel positioning mode wherein the wheel assembly is positioned in a fixed direction; and in a third position, the control element of each wheel assembly selects a wheel positioning mode wherein the wheel assembly can freely swivel in any direction.

23. The apparatus of claim 22, wherein the fixed direction is parallel to a longitudinal axis of the carriage.

24. The apparatus of claim 22, wherein the fixed direction is perpendicular to a longitudinal axis of the carriage.

25. The apparatus of claim 22, wherein the fixed direction provides rotatable motion about a center of the carriage.

26. The apparatus of claim 22, wherein the steering apparatus further includes a steering wheel for controlling a direction of travel of the carriage.

27. The apparatus of claim 22, wherein the carriage includes a plurality of evenly spaced holes for providing attachment locations.

28. The apparatus of claim 22, further including a motive power system for displacing the carriage.

29. The apparatus of claim 22, further including a braking system for stopping and preventing displacement of the carriage.

* * * * *